US005135370A

United States Patent [19]

Iio

[11] Patent Number: 5,135,370

[45] Date of Patent: Aug. 4, 1992

[54] SLIDING-VANE ROTARY COMPRESSOR WITH FRONT END BLOCK AND BEARING ARRANGEMENT

[75] Inventor: Masahiro Iio, Konan, Japan

[73] Assignee: Zexel Corporation, Tokyo, Japan

[21] Appl. No.: 695,084

[22] Filed: May 3, 1991

[30] Foreign Application Priority Data

May 11, 1990 [JP] Japan ..... 2-49376

[51] Int. Cl.[5] ..... F04C 18/344; F04C 29/04

[52] U.S. Cl. ..... 418/83; 418/133; 418/179

[58] Field of Search ..... 418/83, 133, 179, 259

[56] References Cited

U.S. PATENT DOCUMENTS

| | | | |
|---|---|---|---|
| 2,853,023 | 9/1958 | English | 418/133 |
| 3,359,913 | 12/1967 | Halsey | 418/133 |
| 4,619,595 | 10/1986 | Amano et al. | 418/83 |
| 4,770,612 | 9/1988 | Teubler | 418/133 |
| 4,815,953 | 3/1989 | Iio | 418/179 |
| 5,044,908 | 9/1991 | Kawade | 418/179 |
| 5,049,052 | 9/1991 | Aihara | 418/179 |

FOREIGN PATENT DOCUMENTS 2-90389 7/1990 Japan .

*Primary Examiner*—John J. Vrablik

*Attorney, Agent, or Firm*—Wenderoth, Lind & Ponack

[57] ABSTRACT

A sliding-vane rotary compressor including a drive shaft having one end portion rotatably supported by a bearing fitted in a central hole in a rear block, the opposite end portion of the drive shaft extending loosely through a central hole in a front block and being rotatably supported by a bearing fitted in a central bore in a front head, the front head having a plurality of support ribs held in abutment with an outside end face of the front block for supporting the front block. With this construction, the front block and the front bearing are thermally separated from one another, so that a bearing clearance between the front head and the drive shaft is kept always constant even when the front side block is subjected to a high temperature. In addition, by the use of the support ribs, a thinner side block can be used.

10 Claims, 2 Drawing Sheets

SLIDING-VANE ROTARY COMPRESSOR WITH FRONT END BLOCK AND BEARING ARRANGEMENT

BACKGROUND OF THE INVENTION

1. Field of the Invention

The present invention relates to a sliding-vane rotary compressor for use mainly in automobile air-conditioners.

2. Description of the Prior Art

With the trend toward reduction in weight of automobiles, a demand has been created for a lightweight compressor for automobile air-conditioners. To cope with this demand, the material constituting parts defining a compression chamber has been changed to aluminum.

In sliding-vane rotary compressors, a front side block and a rear side block on which bearings are mounted for rotatably supporting the drive shaft of a rotor are made from aluminum or an aluminum alloy. Since aluminum has a relatively large thermal expansion coefficient, the front and rear side blocks made of aluminum are likely to thermally expand when subjected to a high temperature in the vicinity of the drive shaft. As a result, the clearance (bearing clearance) between the drive shaft and each of the bearings is enlarged or widened. One solution to this problem is disclosed in Japanese Utility Model Application No. 63-169271, in which rings of ferrous metal are press-fitted around the respective bearings to limit the thermal expansion of the front and rear side blocks in the vicinity of the bearings. The ferrous metal rings or bushings also under-go thermal expansion when the temperature in the vicinity of the drive shaft is elevated. With this thermal expansion, the bearing clearance is enlarged with the result that an unpleasant operation noise is generated. In addition, the ferrous metal rings are relatively heavy and hence do not meet with the reduced weight requirements of the modern compressor.

SUMMARY OF THE INVENTION

With the foregoing difficulties in view, it is an object of the present invention to provide a sliding-vane rotary compressor which is light in weight and capable of operating silently without involving enlargement of a bearing clearance at the front bearing side which would otherwise bring about generation of operation noise.

According to a first aspect of the present invention, there is provided a sliding-vane rotary compressor which comprises: a compressor body including a cylinder having a substantially elliptical bore defining by an inner peripheral surface of the cylinder, a front block and a rear block which are disposed on opposite ends of the cylinder, the front block having a first central hole through which a drive shaft of the rotary compressor loosely extends, the rear block having a second central hole and a first bearing fitted in the central hole for rotatably supporting one end portion of the drive shaft; a rotor firmly mounted on the drive shaft and rotatably received in the elliptical bore in the cylinder, the rotor carrying thereon a plurality of circumferentially spaced, radially movable sliding vanes; the cylinder, the front and rear blocks, the rotor and the sliding vanes jointly defining therebetween a plurality of compression chambers which vary in volume with each revolution of the rotor; and a front head disposed on an outside end face of the front block and having a central boss, a central bore extending through the boss, and a second bearing fitted in the bore for rotatably supporting the opposite end portion of the drive shaft.

The second bearing on the front is disposed in the front head and hence is thermally isolated from the front block which is subjected to a high temperature during compression of a working fluid in the compression chambers. In addition, the central boss of the front head is separated from the front block. Thus, heat generated from the rotor is substantially prevented from transferring to the second bearing, so that the bearing clearance between the drive shaft and the front bearing is kept always constant without causing accidental enlargement or widening due to thermal expansion.

According to a second aspect of the present invention, there is provided a sliding-vane rotary compressor which comprises: a compressor body including a cylinder having a substantially elliptical bore defining by an inner peripheral surface of the cylinder, a front block and a rear block which are disposed on opposite ends of the cylinder, the front block having a first central hole through which a drive shaft of the rotary compressor loosely extends, the rear side block having a second central hole and a first bearing fitted in the central hole for rotatably supporting one end portion of the drive shaft; a rotor firmly mounted on the drive shaft and rotatably received in the elliptical bore in the cylinder, the rotor carrying thereon a plurality of circumferentially spaced, radially movable sliding vanes; the cylinder, the front and rear blocks, the rotor and the sliding vanes jointly defining therebetween a plurality of compression chambers which vary in volume with each revolution of the rotor; a front head disposed on an outside end face of the front block and having a central boss, a central bore extending through the boss, and a second bearing fitted in the bore for rotatably supporting the opposite end portion of the drive shaft; and a plurality of support ribs integral with the front head and having a front end held in abutment with the outside end face of the front block for supporting the front block.

Since the front block is supported by the plural ribs on its front side, it is possible to reduce the thickness of the front block to half or less than half of the thickness of the rear block. Thus, an additional reduction in weight of the rotary compressor is attained.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in greater detail with reference to a certain preferred embodiment shown in the accompanying drawings.

Figure 1:
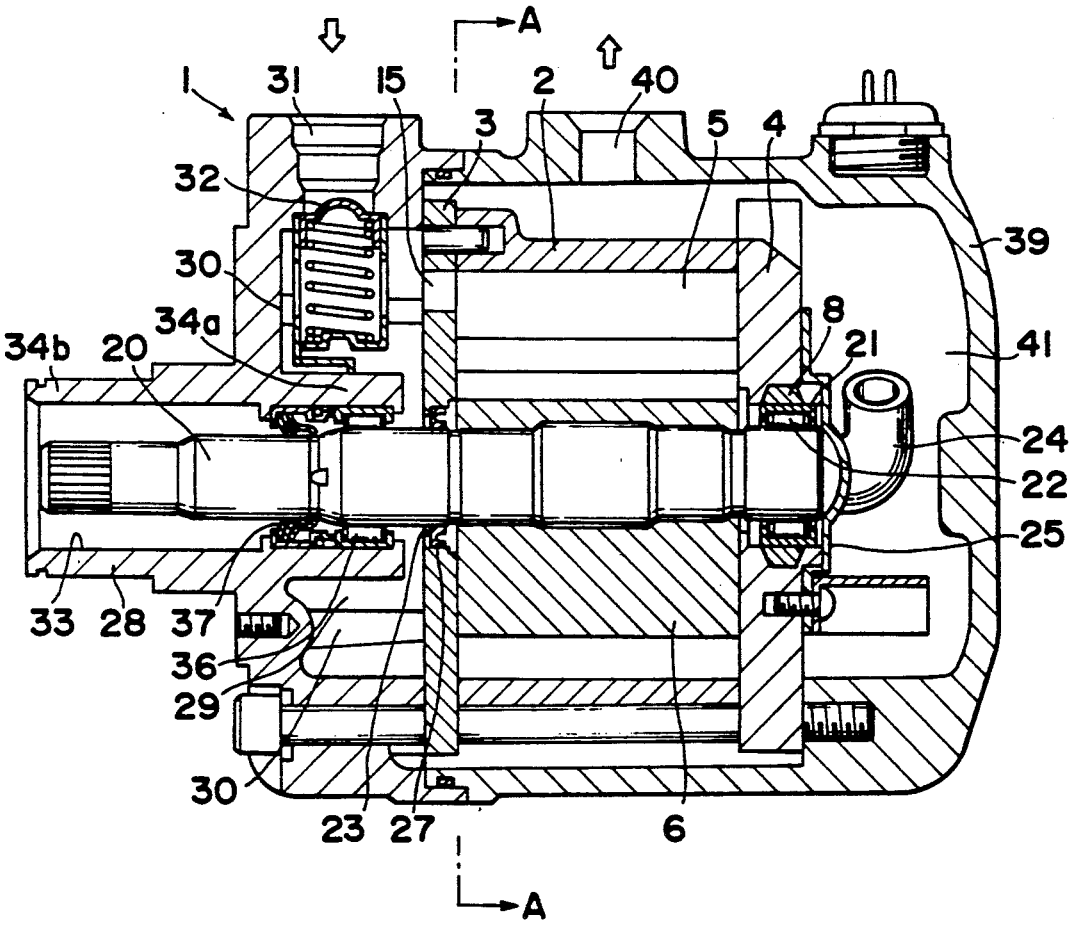
FIG. 1 is a longitudinal cross-sectional view of a sliding-vane rotary compressor according to the present invention.
Figure 2:
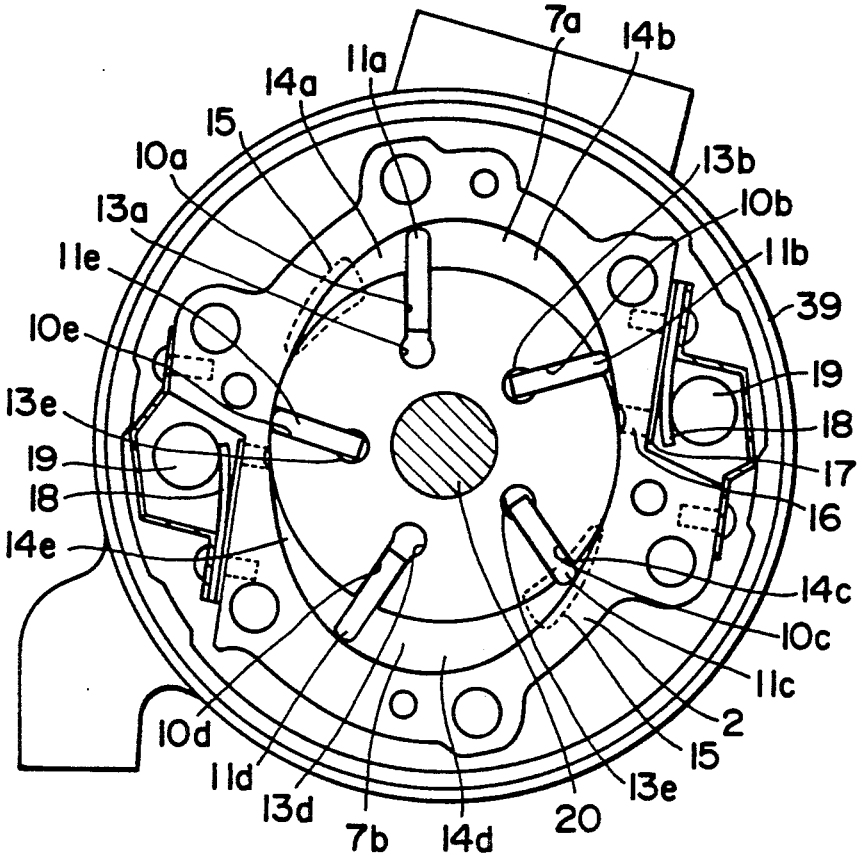
FIG. 2 is a cross-sectional view taken along line 2—2 of FIG. 1.
Figure 3:
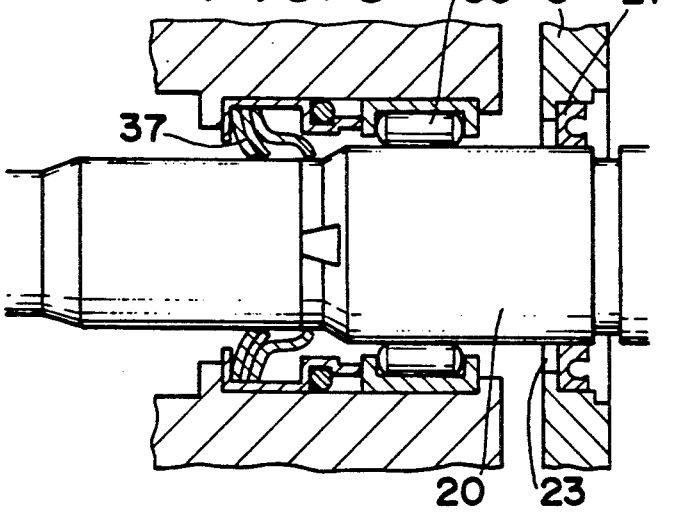
FIG. 3 is an enlarged cross-sectional view showing a portion including a bearing portion of the sliding-vane rotary compressor.

As shown in FIGS. 1 through 3, a sliding-vane rotary compressor 1 includes a cylinder 2 having a substantially elliptical bore defined by an inner peripheral surface of the cylinder 2, a front block 3 and a rear block 4 which are secured to opposite ends of the cylinder 2 so as to jointly constitute a compressor body 5. The compressor body 5 includes a cylindrical rotor 6 rotatably received in the elliptical bore in the cylinder 2, with diametrically opposite portions of the rotor 6 disposed close to the inner peripheral surface of the cylinder 2 at diametrical opposite portions extending along a minor axis of the elliptical bore, so that there are defined between the rotor 6 and the cylinder 2, two operating spaces 7*a*, 7*b* disposed in symmetrical relation to one another.

The front block 3 is made of metal containing aluminum as a chief material and has a thickness which is half or less than half of the thickness of the rear block 4. The front block 3 has a central hole 23.

The rear block 4 is made of metal containing aluminum as a chief material and has a central hole 21 defined substantially by a bushing 8 of ferrous metal which is cast into the material of the rear block 4 as a thermal expansion limiting member.

The rotor 6 is firmly mounted on a drive shaft 20 and has a plurality (five in the illustrated embodiment) of substantially radially extending groves 10*a*–10*e* slidably receiving therein a corresponding number of sliding vanes 11*a*–11*e*.

While the compressor 1 is operating, the vanes 11*a*–11*e* are forced radially outwardly into contact with the inner peripheral surface of the cylinder 2 under the action of a back pressure developed in back-pressure chambers 13*a*–13*e* (into which the pressure in a high pressure chamber is introduced) and also by a centrifugal force produced by the rotation of the rotor 6. Thus, there are defined five compression chambers 14*a*–14*e* by and between the cylinder 2, front and rear side blocks 3, 4, rotor 6 and vanes 11*a*–11*e*.

When the rotor 6 is rotating, the compression chambers 14*a*–14*e* become alternatively larger and smaller so that a working fluid drawn into the compression chambers 14*a*–14*e* from intake holes 15 is compressed and discharged under pressure from discharge holes 16 into a high pressure chamber 41. The intake holes 15 are formed in the front block 3, while the discharge holes 16 are formed in the cylinder 2. The discharge holes 16 are normally closed by discharge valves 17 which are urged into the closed position by retainers 18. The working fluid discharged from the discharge holes 16 through the discharge valves 17 is guided into the high pressure chamber 41 through a discharge passage comprised of a discharge pipe 24.

The drive shaft 20 has an rear end portion rotatably supported by the rear block 4 via a roller bearing 22 fitted in the central hole 21 of the rear block 4. The front end portion of the drive shaft 20 extends outwardly through the central hole 23 in the front block 3 and is rotatably supported by a front head 28 via a roller bearing 36 fitted in a boss 34*a* of the front head 28. The central hole 21 in the rear block 4 is closed by a cover 25 secured to an outside end face of the rear block 4, so that the compressed working fluid is blocked from flowing into the central hole 21. A seal 27 is mounted on the drive shaft 20 inside the central hole 23 to seal the working fluid inside the cylinder 2 against leakage through the central hole 23.

The front head 28 is firmly connected to the front block 3 with its support ribs 30 held in abutment with the outside end face of the front block 3, so that there is defined between the front head 28 and the front block 3 a low pressure chamber 29 from which the working fluid is drawn into the compression chambers 14*a*–14*e*. The low pressure chamber 29 communicates with the operating spaces 7*a*, 7*b* through the intake holes 15 and also is connected with an inlet 31 through which the working fluid is drawn into the low pressure chamber 29. The inlet 31 is provided with a check valve 32.

The front head 28 is preferably made of ferrous sintered metal and has a central bore 33 in which the front end portion of the drive shaft 20 is loosely received. The central bore 33 extends through the boss 34*a* (inner boss) and an outer boss 34*b*. The inner boss 34*a* extends toward the front block 3 and terminates short of the front block 3 with an appropriate space therebetween. The roller bearing 36 is mounted in the inner boss 34*a* and rotatably supports the drive shaft 20 on the front head 28. A shaft seal 37 is mounted in the inner boss 34*a* on the outside of the bearing 36 to provide a hermetic seal therebetween for preventing the working fluid from leaking outside the bearing 36. The shaft seal 37 is attached to the inner boss 34 by using a portion of the inner boss 34 and a portion of the bearing 36.

The support ribs 30 of the front head 28 are circumferentially spaced from one another and, as described above, they are held in abutment with the outside end face of the front block 3 at the front end thereof. The support ribs 30 thus provided serve to reinforce the front block 3 against deformation.

The front head 28 is connected to an open end of a cup-shaped shell 39 in which the compressor body 5 is received. The cup-shaped shell 39 has a discharge opening 40 connected at one end with the high pressure chamber 41 which is defined between the shell 39 and the compressor body 5.

The sliding-vane rotary compressor 1 of the foregoing construction operates as follows.

When the drive shaft 20 is driven to rotate the rotor 6, the vanes 11*a*–11 slide along the inner peripheral wall of the cylinder 2 to cause the compression chambers 14*a*–14*e* vary in volume with each revolution of the rotor 6.

In the suction stroke, the compression chambers 14*1*–14*e* become larger in volume and hence the internal pressure in the compression chambers 14*a*–14*e* becomes smaller than the pressure of the low pressure chamber 29, so that the working fluid supplied through the check valve 32 into the low pressure chamber 29 is drawn into the compression chambers 14*a*–14*e*. When the succeeding vanes 11*a*–11*e* move past the intake holes 15, the working fluid is trapped in the compression chambers 14*a*–14*e* and progressively compressed as the volume of the compression chambers 14*a*–14*e* becomes smaller. Thereafter, the preceding vanes 11*a*–11*e* move past the discharge holes 16, the compressed working fluid forces the discharge valve 17 to open and flows into the high pressure chamber 41 and thence to the discharge opening 40 from which the compressed working fluid is discharged to the outside of the sliding-vane rotary compressor 1.

Due to the compression of the working fluid, the front block 3 and the rear side block 4 are subjected to a high temperature. However, since the bearing 36 on the front side block 3 is disposed in the front head 28 and hence thermally separated from the front block 3, heat is from the front block 3 is not transferred to the bearing 36. It is, therefore, no longer necessary to provide a reinforcement member (thermal expansion limiting member) of ferrous metal around the bearing 36. In addition, due to the absence of the bearing 36, the front block 3 is not subjected to loads exerted from the drive shaft 20. It is, therefore, possible to reduce the thickness and hence the weight of the front block 3 without the need for a particular reinforcement member other than the support ribs 30 on the front head 28. The front head 28 may be made from ferrous sintered metal in which instance an additional weight reduction of the rotary compressor can be obtained without providing a special reinforcement protection layer on the front head 28. Thus, the front block 3 and the front head 28 can be manufactured at less cost than heretofore.

The shaft seal 37 and the bearing 36 are disposed side by side, so that the shaft seal 37 can be retained in position by using a portion of the bearing 36 as a stopper.

Obviously, various minor changes and modifications of the present invention are possible in the light of the above teaching. It is therefore to be understood that within the scope of the appended claims the invention may be practiced otherwise than as specifically described.

What is claimed is:

1. A sliding-vane rotary compressor, comprising:

(a) a compressor body including a cylinder having a substantially elliptical bore defining by an inner peripheral surface of said cylinder, a front block and a rear block which are disposed on opposite ends of said cylinder, said front block having a first central hole through which a drive shaft of said rotary compressor loosely extends, said rear block having a second central hole and a first bearing fitted in said central hole for rotatably supporting one end portion of said drive shaft;

(b) a rotor firmly mounted on said drive shaft and rotatably received in said elliptical bore in said cylinder, said rotor carrying thereon a plurality of circumferentially spaced, radially movable sliding vanes;

(c) said cylinder, said front and rear blocks, said rotor and said sliding vanes jointly defining therebetween a plurality of compression chambers which vary in volume with each revolution of said rotor; and (d) a front head disposed on an outside end face of said front block and having a central boss, a central bore extending through said boss, and a second bearing fitted in said bore and rotatably supporting the other end portion of said drive shaft, said central boss having an inner end spaced a distance from said front block so as to be completely separate from and in non-heat transfer relationship with said front block.

2. A sliding-vane rotary compressor according to claim 1, wherein said front head is made from ferrous sintered metal.

3. A sliding-vane rotary compressor according to claim 1, wherein said front block has a thickness which is half or less than the thickness of said rear block.

4. A sliding-vane rotary compressor according to claim 1, wherein said rear block includes an annular thermal expansion limiting member defining said second central hole.

5. A sliding-vane rotary compressor according to claim 4, wherein said thermal expansion limiting member is a bushing of ferrous metal.

6. A sliding-vane compressor, comprising:

(a) a compressor body including a cylinder having a substantially elliptical bore defining by an inner peripheral surface of said cylinder, a front block and a rear block which are disposed on opposite ends of said cylinder, said front block having a first central hole through which a drive shaft of said rotary compressor loosely extends and having a thickness half or less than the thickness of said rear block, said rear block having a second central hole and a first bearing fitted in said central hole for rotatably supporting one end portion of said drive shaft;

(b) a rotor firmly mounted on said drive shaft and rotatably received in said elliptical bore in said cylinder, said rotor carrying thereon a plurality of circumferentially spaced, radially movable sliding vanes;

(c) said cylinder, said front and rear blocks, said rotor and said sliding vanes jointly defining therebetween a plurality of compression chambers which vary in volume with each revolution of said rotor;

(d) a front head disposed on an outside end face of said front block and having a central boss, a central bore extending through said boss, and a second bearing fitted in said bore and rotatably supporting the other end portion of said drive shaft; and (e) a plurality of support ribs integral with said front head and spaced at intervals around the periphery of said front head, each support rib having a front end held in abutment with said outside end face of said front block for supporting the front block.

7. A sliding-vane rotary compressor according to claim 6, wherein said central boss has an inner end spaced a distance from said front block.

8. A sliding-vane rotary compressor according to claim 6, wherein said front head is made from ferrous sintered metal.

9. A sliding-vane rotary compressor according to claim 6, wherein said rear block includes an annular thermal expansion limiting member defining said second central hole.

10. A sliding-vane rotary compressor according to claim 9, wherein said thermal expansion limiting member is a bushing of ferrous metal.

* * * * *